US005850885A

United States Patent [19]

Clark et al.

[11] Patent Number: 5,850,885

[45] Date of Patent: Dec. 22, 1998

[54] METHOD AND APPARATUS FOR A GAME

[76] Inventors: W. Steve Clark, 5293 Denmans Mountain Rd.; Eric J. Theriot, 5491 Denmans Mountain Rd., both of Belton, Tex. 76513

[21] Appl. No.: 994,055

[22] Filed: Dec. 19, 1997

[51] Int. Cl.[6] ..... A63B 67/00; F41J 3/00

[52] U.S. Cl. ..... 273/317; 273/408; 273/409

[58] Field of Search ..... 273/317, 348, 273/403, 404, 408, 409

[56] References Cited

U.S. PATENT DOCUMENTS

| | | |
|---|---|---|
| D. 296,708 | 7/1988 | Garrett . |
| D. 303,824 | 10/1989 | Maloney, II . |
| D. 313,435 | 1/1991 | Brost . |
| D. 330,227 | 10/1992 | Frankland et al. . |
| D. 343,868 | 2/1994 | Tolson . |
| D. 345,381 | 3/1994 | Varga . |
| D. 350,158 | 8/1994 | Daneault . |
| D. 365,601 | 12/1995 | Wu . |
| D. 373,147 | 8/1996 | Varga . |
| D. 382,600 | 8/1997 | Wu . |
| 3,979,117 | 9/1976 | Worsham . |
| 5,050,890 | 9/1991 | Havens . |
| 5,417,437 | 5/1995 | Coppard et al. . |
| 5,540,446 | 7/1996 | Felsen . |

*Primary Examiner*—William H. Grieb
*Attorney, Agent, or Firm*—Vaden, Eickenroht & Thompson, L.L.P.

[57] ABSTRACT

A new game and apparatus for playing the game are disclosed. The game involves throwing darts onto specially designed dart board. The board is subdivided into different targets each having a number of point areas. Each target is associated with a specific player although only the player knows the identity of his or her target. During the game, players take turns throwing darts at the targets. When a dart lands on a target's point area, the points are scored against that target. When a target's score reaches or exceeds a set elimination value, the player associated with that target is eliminated from the game. Further, during the game, a player may identify his or her target after their score exceeds a set 'FESSUP™ value. After identifying one's own target, the player can deduct points from his or her score by landing darts in his or her own target point areas. The game in not limited to darts and dart boards but can be manufactured from a variety of materials that will allow it to be safely played children and adults of all ages. Further, it is expected that the game will be modified to be played indoors and out and on both vertical and horizontal surfaces.

19 Claims, 1 Drawing Sheet

FIG. 1
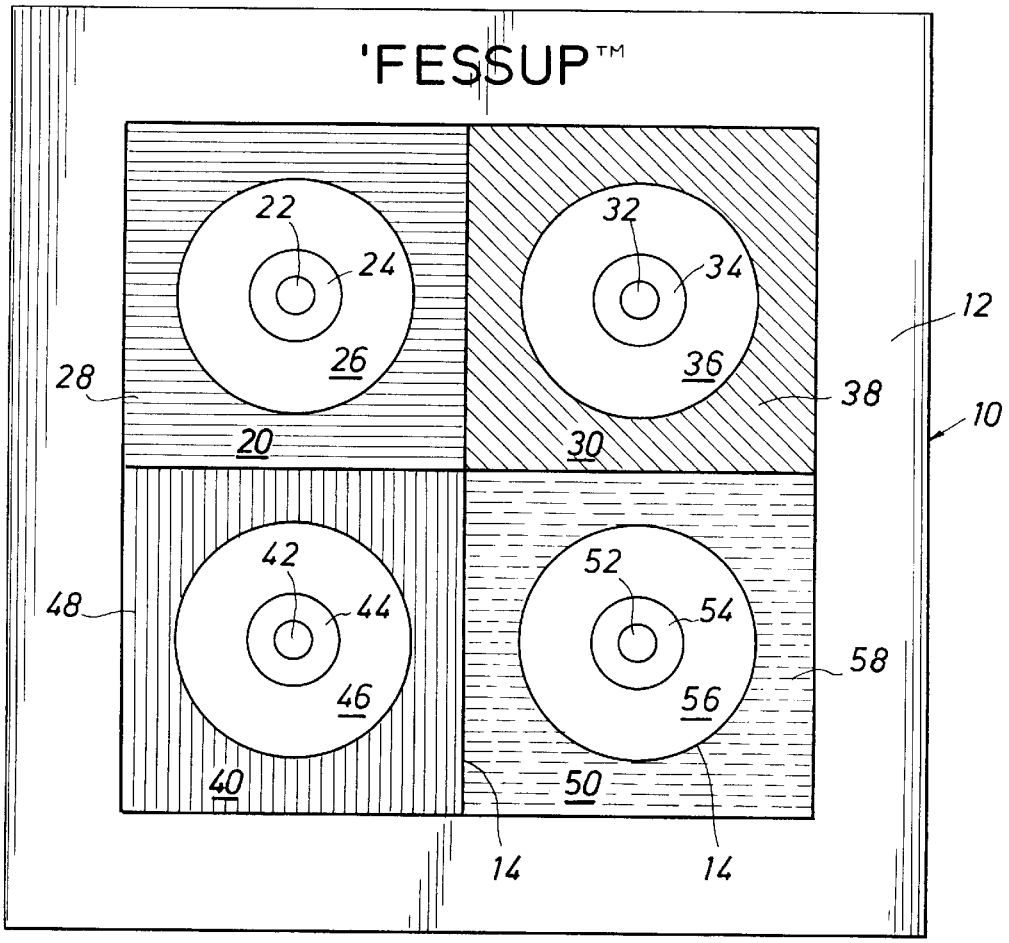
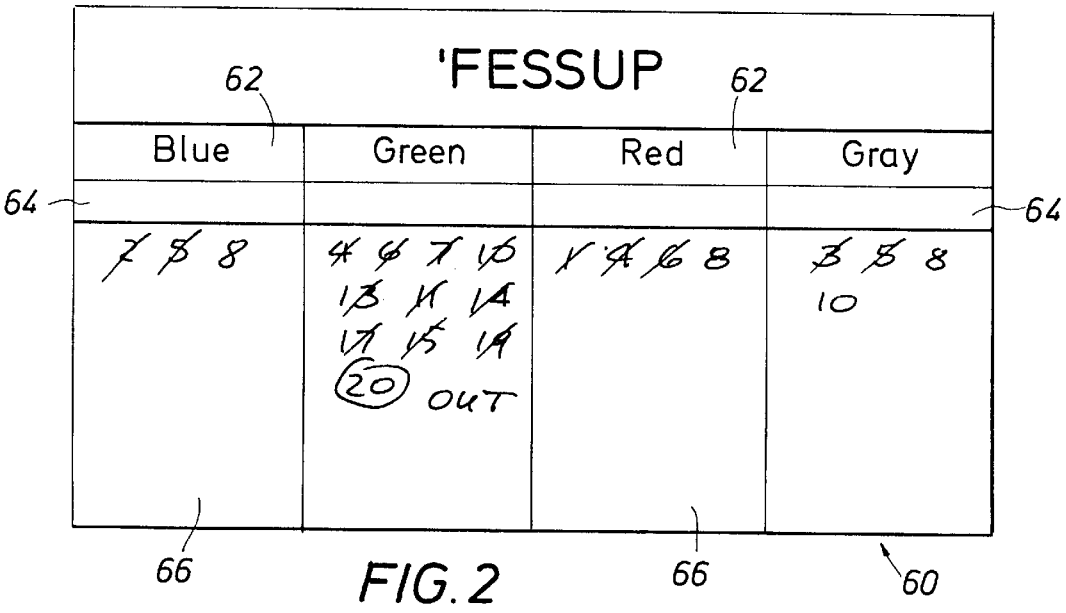
FIG. 2

METHOD AND APPARATUS FOR A GAME

BACKGROUND OF THE INVENTION

1. Field of the Invention

This invention pertains to games generally, and more specifically, games which utilize throwing pieces and a playing surface onto which the throwing pieces are thrown. More specifically still, the present invention concerns a new dart game and a dart board designed specifically for that game.

Conventional dart board games such as "cricket", "301" and "501" require each player to possess a high degree of skill and accuracy for hitting a preselected specific target area. The game of the present invention introduces elements of strategy and deception to enhance its appeal to all players regardless of their throwing ability. Therefore, the present invention allows both seasoned and novice players, or for that matter anyone who can throw a dart, to play and win the game.

2. Description of the Prior Art

The prior art contains a number of different types of games that are played using a traditional circular dart board. In some cases, the surface of the board has been reconfigured for a specific type of game and in others, the game has required that the board have a significantly different surface design and shape.

U.S. Pat. No. 3,979,117 is entitled "Football Dart Board Game." The board in the '117 Patent consist of three traditional circular boards that have been modified and hung adjacent to one another. Each of the three different boards has target areas which represent specific results for different types of American football plays. The three boards represent offensive plays such as various running, passing and kicking plays, respectively. One of the objects of the invention is that the scores between the two opposing players be indicative of their respective dart throwing and play selection abilities. Because, the game is heavily dependent on the players' throwing ability and their understanding of the game of football, it is not appealing to players who lack these characteristics.

U.S. Design Pat. No. 296,708 is entitled "Dartboard or the Like." Design Pat. No. '708 discloses in FIGS. 1 and 2, what appears to be a traditional circular dart board. However, the target area of the board has been reconfigured to have the appearance of a standard billiards table having six pockets and fifteen billiard balls "racked" into the typical triangle configuration. Alternatively, FIG. 3 of Design Pat. No. '708 shows essentially the same illustration as FIG. 1 applied to a rectangular board. There is no disclosure as to how a game would be played on the illustrated boards.

U.S. Pat. No. 5,050,890 is entitled "Dart Board Game." The '890 patent discloses a dart game in which the dart board is subdivided into two separate zones. A number of circular targets are arranged in each zone, such that a player throws at targets in the other player's zone. Ancillary spaces are marked in each zone of the dart board for introducing different strategies into the game. Such spaces are usable to increase or decrease the number of darts in the game, or to increase the number of hits required to destruct a circular target. The object of the game is for each player to destroy the other player's targets by throwing darts onto such targets a specified number of times. The winner is the player who first destroys all of the other player's targets. The game disclosed in the '890 patent is limited to two players. The players know precisely what targets they must hit in order to win the game and therefore no strategy or deception is involved. The game is simply one of throwing skill between the two players.

U.S. Design Pat. No. 350,158 is entitled "Lotto Dart Board. " The dart board illustrated in Design Pat. '158 appears to be a standard circular dart board, the target area of which has been divided into variously sized and shaped spaces that are randomly numbered from one to forty. The board is illustrated as having an inner and an outer bull target areas. Although no disclosure concerning the board's use is provided, one might speculate that the board is intended to be used by persons who participate in lottery drawings where numbers are randomly drawn to determine a winning combination of numbers.

U.S. Pat. No. 5,417,437 is entitled "Dart Board and Method of Manufacture." This patent discloses a traditional circular dartboard comprising a bristle board, inner and outer bull target areas, and radial target areas arranged around the bulls. The novelty of this invention appears to be derived from the interlocking nature of strips that are mounted on the board and which delineate between the different target areas on the board's surface. Formerly, target areas were delineated with heavy gauge wire or non-interlocking strips that were prone to being bent resulting in an alteration of the shapes of the various target areas.

U.S. Design Pat. No. 365,601 is entitled "Dart Board." The disclosure of this patent is illustrated as a traditional circular dart board that typically utilize darts with plastic tips. It is also well known in the art that such boards will be equipped with electronic automated scoring.

U.S. Pat. No. 5,540,446 is entitled "Covers and Target Pattern Appliques." This patent is directed to covers and removable replaceable target patterns appliques for use with standard circular dart boards, archery targets and the like. The covers allow the user to remove and replace a variety of target patterns. The invention comprises a frame which is attached to a standard circular dart board, means for holding the frame on the board, and a target pattern to be placed in the frame. Although the disclosure of the '446 patent indicates that target patterns other than traditional dart board designs can be placed on the targets, the disclosure does not include or describe a specific target pattern or any new games that might be played on that target pattern.

U.S. Design Pat. No. 373,147 is entitled "Game Target." The drawings appear to disclose a specially configured dart board having the design of a baseball field. Special target areas are designated for home plate, the pitcher's mound, the three bases and left and right fields. The game board further comprises a score board with designations for one player or team to represent the home team and the opponent(s) to be the visitors. No method of playing a game on the board is disclosed.

U.S. Design Pat. No. 382,600 is entitled "Dart board." The illustrated board appears to be a traditional circular dart board providing automated electronic scoring on displays below the board. The illustrations of the board suggest that plastic tipped darts are used as is well known in the art for these types of boards.

SUMMARY OF THE INVENTION

It is an object of the present invention to provide a new game that combines elements of strategy, chance and throwing skill such that a number of different players may effectively compete with one another regardless of their respective throwing abilities.

It is a further object of the invention to provide an apparatus for playing a throwing game comprising a plurality of game pieces, a playing surface for receiving thrown game pieces, a plurality of target areas arranged on the playing surface, each target area having a plurality of point areas each having a different point value and means for identifying each target area with a separate player.

It is another object of this invention to provide a method of playing a throwing game that is initiated by determining the order of play among a number of players and associating each player with a target on the playing surface but not revealing the association between target and player. Each player, during his turn, throws a fixed number of game pieces at one or more of the targets attempting to land the game pieces within the point areas on the target(s). At the completion of each player's turn, a total for each target is generated by adding the points where each of the thrown game pieces landed. Players are eliminated when the point total for their target reaches an elimination value. The winner is declared when all but one of the players have been eliminated.

It is yet another object of this invention to provide a method of playing a throwing game that is initiated by determining the order of play among a number of players and associating each player with a target on a playing surface but not revealing the association between target and player. Each player, during their turn, throws a fixed number of game pieces at one or more of the targets attempting to land the game pieces within the point areas on the target(s). At the completion of each player's turn, a total for each target is generated by adding the points for the point areas where each of the thrown game pieces landed. When a player's point total reaches a certain value during the game, that player has the option of identifying his target to the other players. After a player identifies his target, any points he obtains from his own point areas during his turn are subtracted from his target's total. Players are eliminated when the point total for their target reaches an elimination value. The winner is declared when all but one of the players have been eliminated.

BRIEF DESCRIPTION OF THE DRAWINGS

So that the manner in which the above-recited features, advantages and objects of the invention, as well as others which will become apparent, are attained and can be understood in detail, a more particular description of the invention briefly summarized above maybe had by reference to the exemplary embodiments thereof which are illustrated in the appended drawings, which form a part of this specification. It is to be noted however, that the drawings illustrate only typical preferred embodiments of the invention and are therefore not to be considered limiting of its scope as the invention may admit to other equally effective embodiments.

In the Drawings:

FIG. 1 is a frontal view of an apparatus of the present invention depicting the playing surface as being subdivided into a plurality of target areas, the target areas being lined to indicate the colors blue, green, gray and red, respectively.

FIG. 2 is an illustration of a score card that may be used with the present invention.

DESCRIPTION OF THE PREFERRED EMBODIMENTS

Although the invention is described herein as being embodied in a dart board playing surface and utilizing darts as the game pieces, it is anticipated that the invention may take the form of a variety of different types of playing surfaces and game pieces. Further, the playing surface should not be understood as being limited to vertical application as the game may be played on either a vertical or horizontal playing surface.

The game pieces and the playing surface will be complementary in the sense that the playing surface will receive thrown game pieces and or the thrown game pieces will attach to the playing surface. The types of materials used to play the game will depend largely on the age of the players. Young children can safely play the game using game pieces and a playing surface covered with hook and loop material, e.g. VELCRO®, while older children and adults can play the game using traditional darts and dart boards. If the game is to be played on a horizontal surface such as a floor, game pieces such as bean bags, washers, and the like may be thrown. Since it is anticipated that the game might adapted to be played both indoors and out, additional types of game pieces will include lawn darts, horse shoes and a variety of other items.

An apparatus for the game of the present invention will include a plurality of game pieces. The appropriate type of game piece used will depend on factors such as the age of the players, the orientation of the playing surface, whether the game is to be played indoors or out, and most importantly, the material of the playing surface. For vertical applications it is essential that the game pieces be chosen such that they engage or attach to the playing surface. This attachment is most commonly a frictional engagement although the interlocking of hook and loop fastening materials is anticipated. In the preferred embodiment, the game pieces will be a number of conventional type darts each having an elongated body that is pointed at one end and typically feathered on the opposite end.

The game of the present invention further includes a playing surface for receiving thrown game pieces. As shown in FIG. 1 and as described herein, the invention includes playing surface 10 having border 12, and four target areas 20, 30, 40 and 50. Each target area has a number of circles delineating point areas that are concentrically arranged around the center of the target area. Outside the outermost concentric circle of each target area is dead space. By way of example, target area 20 is illustrated as having point areas 22, 24 and 26 and dead space 28. Each of the point areas and dead space has a specific predetermined point value. Although in no way to be considered limiting, it is expected that the innermost point space will have the largest point value with progressively decreasing point values for the point spaces farther from the center. For example, point area 22 may be worth three points, point area 24 may be worth two points, point area 26 may be worth one point while dead space 28 is worth zero points.

Each target area should have means for identify it separate and apart from the other target areas on the playing surface. Identification means may simply be the use of a different color in each target area, but it may also include the use of different numbers, words, names or symbols. As shown in FIG. 1, the dead space of each of the target areas on playing surface 10 has been lined for a different color to distinguish among the target areas.

Playing surface 10 can be composed of a variety of materials depending largely on the environment in which the game is to be played and the types of game pieces that will be utilized. If the game is intended for use by young children, the playing surface will have a mesh or weave of fibers in the target areas that will interact with game pieces that are covered with hook material. If the game is to be played on a horizontal surface, the playing surface may be applied to a fabric that is spread over the surface or to a board that may be unfolded over the surface.

In the preferred embodiment, the game of the present invention is played using traditional metal tipped darts and a bristle dart board manufactured using conventional materials and methods. A bristle board is defined for the purposes of this specification and claims as being a dart board made from pig bristle, vegetable fiber or synthetic fiber where the fibers are aligned approximately with the central axis through the face of the board. When vertically arranged on a wall, this axis is substantially horizontal. The term "bristle dart board" is used in the industry to cover those original dart boards made from pig bristle but which are now made from a vegetable fiber such as sisal and may alternatively be made from synthetic fibers. Of course, the general construction of such a dart board approximates that of the original bristle boards.

The various dividers 14 that delineate between the various target areas on the playing surface and the point areas within each target area may be manufactured from metal strips, heavy gauge wire, or other materials known to those skilled in the art. In addition, these dividers may be provided with various polymeric or metallic coatings.

The method of playing the game of the present invention is fairly straight forward. In the preferred embodiment, the rectangular dart board playing surface is oriented vertically on a wall. The playing surface is positioned with its center approximately five feet and six inches above the floor and the players throw the game pieces from approximately seven feet and six inches from the playing surface.

The players will determine the order of play by blindly drawing numbers from a bag, however, any known method may be used that will randomly establish the order of play. After the order of play is established, each player will be associated with a different target area on the playing surface. Each target area will have means for identifying it from the other target areas. The identification means may be a distinct color, number, word or symbol. Matching players with target areas may be accomplished by any known method, but it should be carried out blindly so that only the player knows his or her target. Again, items bearing corresponding identification means may be placed in a bag and blindly drawn by the players to associate players with targets.

The players, in the order of play that has been determined, will each throw a number of game pieces at the target areas of the playing surface. There is no limitation on the number of game pieces that may be thrown, but it is preferable that the number of game pieces thrown each turn does not exceed the number of players. Preferably, each player will throw three darts during a turn. For each dart landed in the point areas of a target, points are accumulated against that target and implicitly against the player associated with that target. At the conclusion of a player's turn, a score for each target is calculated by adding any new points to any preexisting score for that target.

A score is maintained for each target throughout the game. FIG. 2 shows score sheet 60 on which the running point totals for target areas 20, 30, 40 and 50 are maintained. The means used to distinguish among the target areas, in this case the colors blue, green, red, and gray, are listed in sections 62 to associate scores with targets. After each player's turn, the points associated with the player's throws are recorded and or a running total is calculated in sections 66. When the score for a target area reaches an elimination value, the player associated with that target area has been eliminated from the game. The elimination value is preferably 20 points but it may be set at any other desired level, depending on the general skill level of the players and a desired length of the game. As shown in FIG. 2, the player associated with the green target has been eliminated.

A player's objective in order to win the game is to accumulate points against the other player's targets thereby eliminating the other players. Note however, that because a player does not know which target is associated with an opponent, it is difficult to eliminate any one particular player. Further, a deceptive element may be introduced when players choose to accumulate points against their own target.

In an alternative method of playing the game, a player is given the option of revealing the identity of his or her target to the other players. Players do not acquire this option until after the running total of points associated with their target reaches a predetermined 'FESSUP™ value. Typically, the 'FESSUP ™ value will be one half or some larger fraction of the elimination value for the game, thus, the 'FESSUP™ value will be 10or more when the elimination value is 20.As shown in FIG. 2, score sheet 60 is provided with sections 64 for associating a player's name with a particular target and running point total. Note that a player is not obligated to identify his target even though his point total exceeds the predetermined value.

In return for identifying one's target, a player is given the opportunity to deduct points from his score, perhaps, enabling him to prevent his elimination from the game. Specifically, when the revealing player lands darts on his own point areas during his turn, those points are deducted from rather than added to his target's score. For example, in FIG. 2, before the player associated with the green target was eliminated from play, he chose to identify his target to the other players. During the course of continued play, he was able to reduce his running point total from 13 to 11 points and later from 17 to 15 points and was thereby able to delay, although not to prevent, his elimination from the game.

If there are fewer players than target areas on the playing surface, the game may be played out in a variety of ways. A target that is not associated with a player may be identified as such prior to the beginning of play and the players will simply ignore the extra targets and play the game according to the description set out above. Alternatively, the identity of any extra targets should not be revealed to the players in order to enhance the deceptive elements of the game. When the game is played such that the players are allowed to identify their targets after their score exceeds the 'FESSUP™ value, any extra targets should be identified only after one of the players identifies his or her own.

From the foregoing it will be seen that this invention is one well adapted to attain all of the ends and objects hereinabove set forth, together with other advantages which are obvious and which are inherent to the apparatus and method disclosed.

It will be understood that certain features and subcombinations are of utility and may be employed without reference to other features or subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for a game comprising:

a plurality of game pieces to be thrown onto a playing surface;

a playing surface for receiving thrown game pieces;

a plurality of target areas arranged on the playing surface, each target area having a plurality of concentrically arranged point areas each having a different point value and being centered about the center of the target area; and means for identifying each target area with a separate player.

2. The apparatus of claim 1, wherein the target identification means is a different color in each target area.

3. The apparatus of claim 1, wherein the target identification means is a different number in each target area.

4. The apparatus of claim 1, wherein the game pieces are darts and the playing surface is a dart board.

5. The apparatus of claim 1, wherein each target area has dead space.

6. The apparatus of claim 1, wherein there are four target areas.

7. The apparatus of claim 1, wherein there are three point areas on each target area.

8. A method of playing a throwing game, comprising the steps of:

determining the order of play among a plurality of players;

associating each player with a target area on a playing surface but not revealing that association to the other players, each target area having a plurality of point areas having different point values;

each player, during their turn, throwing a number of game pieces at one or more of the point areas;

at the completion of each player's turn, generating a score for each target area by adding the point values for the point areas where each of the thrown game piece landed;

eliminating a player when the score for their target area reaches an elimination value; and declaring a winner when all of the other players have been eliminated.

9. The method of claim 8, further comprising the step of allowing a player to identify his target area to the other players after the score for that player's target area has exceeded a predetermined value.

10. The method of claim 9, wherein after a player has identified his target area, point values for each of the game pieces that landed in that player's point areas during that player's turns are deducted from his target's score.

11. The method of claim 8, wherein the players throw the game pieces at a vertical playing surface.

12. The method of claim 11, wherein the center of the playing surface is more than five feet from the ground.

13. The method of claim 10, wherein the players are at least 7feet from the playing surface when throwing the game pieces.

14. The method of claim 8, wherein there are fewer players than target areas on the playing surface, and wherein any target areas not associated with a player are identified before the first turn.

15. The method of claim 8, wherein there are fewer players than target areas on the playing surface, and wherein any target areas not associated with a player are not identified during the game.

16. The method of claim 9, wherein there are fewer players than target areas on the playing surface, and wherein any target areas not associated with a player are identified when a player identifies his target area.

17. The method of claim 8, wherein the order of play among the players is determined by each player drawing a number from a game bag.

18. The method of claim 8, wherein a player is associated with a target area by drawing an item associated with a target area from a game bag.

19. The method of claim 8, further comprising the step of recording the score for each target area on a score card visible to all players.

* * * * *